US010515739B2

(12) United States Patent
Satou et al.

(10) Patent No.: US 10,515,739 B2
(45) Date of Patent: Dec. 24, 2019

(54) CONDUCTIVE MEMBER AND METHOD FOR PRODUCING CONDUCTIVE MEMBER

(71) Applicant: SUMITOMO WIRING SYSTEMS, LTD., Mie (JP)

(72) Inventors: Osamu Satou, Mie (JP); Masamichi Yamagiwa, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 67 days.

(21) Appl. No.: 15/772,662

(22) PCT Filed: Nov. 7, 2016

(86) PCT No.: PCT/JP2016/082959
§ 371 (c)(1),
(2) Date: May 1, 2018

(87) PCT Pub. No.: WO2017/082203
PCT Pub. Date: May 18, 2017

(65) Prior Publication Data

US 2018/0322982 A1 Nov. 8, 2018

(30) Foreign Application Priority Data

Nov. 12, 2015 (JP) ..... 2015-221797

(51) Int. Cl.
*H01B 5/02* (2006.01)
*H01B 5/12* (2006.01)
(Continued)

(52) U.S. Cl.
CPC ..... *H01B 5/02* (2013.01); *C22F 1/08* (2013.01); *H01B 1/026* (2013.01); *H01B 5/08* (2013.01);
(Continued)

(58) Field of Classification Search
CPC . H01B 1/02; H01B 1/026; H01B 5/02; H01B 5/12; H01B 5/08; H01B 7/02;
(Continued)

(56) References Cited

U.S. PATENT DOCUMENTS 368,765 A * 8/1887 Hammer ..... H01B 7/00
174/84 C
2,806,215 A * 9/1957 Redslob ..... H01R 4/62
174/84 C
(Continued)

FOREIGN PATENT DOCUMENTS

| | | | | |
|---|---|---|---|---|
| JP | 2011-054374 | | 3/2011 | |
| JP | 2011-054374 A | * | 3/2011 | ..... H01B 5/02 |
| JP | 2015-095313 | | 5/2015 | |
| JP | 2015-095313 A | * | 5/2015 | ..... H01B 7/00 |
| WO | 2014/077144 | | 5/2014 | |

OTHER PUBLICATIONS

Official Communication issued in International Bureau of WIPO Patent Application No. PCT/JP2016/082959, dated Feb. 7, 2017.

*Primary Examiner* — William H. Mayo, III
(74) *Attorney, Agent, or Firm* — Greenblum & Bernstein, P.L.C.

(57) ABSTRACT

Sufficient welding of multiple metal wires in at least a portion of a conductive member that is constituted by multiple metal wires is enabled. The conductive member includes multiple metal wires each including a metal strand and a metal covering layer formed around the metal strand, and a joined portion in which the metal wires are joined by melting of alloy portions of the metal covering layers, the alloy portions including the metal that forms the metal strands. The joined portion can be formed by joining the metal wires to each other by performing heating at a temperature higher than the melting point of the alloy portions of the metal covering layers, the alloy portions including the metal that forms the metal strands.

6 Claims, 3 Drawing Sheets

(51) Int. Cl.

| | |
|---|---|
| ***H01B 7/04*** | (2006.01) |
| ***C22F 1/08*** | (2006.01) |
| ***H01B 1/02*** | (2006.01) |
| ***H01B 5/08*** | (2006.01) |
| ***H01B 13/00*** | (2006.01) |

(52) U.S. Cl.
CPC ..... *H01B 5/12* (2013.01); *H01B 7/04* (2013.01); *H01B 13/0013* (2013.01)

(58) Field of Classification Search
CPC ..... H01B 7/04; H01B 7/0009; H01B 13/02; H01B 13/0013
USPC ..... 174/74 R, 78, 84 R, 84 C
See application file for complete search history.

(56) References Cited

U.S. PATENT DOCUMENTS 3,181,110 A * 4/1965 Raborg ..... H01R 4/185 29/512
3,587,030 A * 6/1971 Ohnsorg ..... H01B 5/12 439/502
3,706,955 A * 12/1972 Bunnell ..... H01B 7/0009 174/126.1
4,922,072 A * 5/1990 Topel ..... B23K 11/002 219/56.1
4,973,370 A * 11/1990 Kreinberg ..... H01R 4/2495 156/50
5,541,380 A * 7/1996 Ogden ..... H01R 11/12 219/56

* cited by examiner

CONDUCTIVE MEMBER AND METHOD FOR PRODUCING CONDUCTIVE MEMBER

TECHNICAL FIELD

This invention relates to technology for welding multiple metal wires in a conductive member that is constituted by multiple metal wires.

BACKGROUND ART

Patent Document 1 discloses an insulated wire that includes a core wire and an insulating covering that covers the outer surface of the core wire while exposing an end portion of the core wire, wherein a leading end portion of the end portion is formed with the shape of a terminal connection portion that can come into direct contact with and be connected to a partner terminal with which a connection is to be made. In Patent Document 1, the core wire is formed by multiple strands, and the leading end portion is formed with the shape of the terminal connection portion by welding of the strands.

CITATION LIST

Patent Documents

Patent Document 1: JP 2015-95313A

SUMMARY OF INVENTION

Technical Problem

However, according to the technology disclosed in Patent Document 1, the joining strength of the strands to each other is weak, and the overall strength of the terminal connection portion shape also tends to be insufficient.

Upon investigating the cause of this, the inventors of the present invention found that the alloy plating formed around the strands has a high melting point, and this causes the welding of the strands together to be insufficient.

Specifically, copper is normally used for the strands that constitute the core wire. Also, the copper is plated with tin or the like. When the copper is plated with tin or the like, an intermetallic compound is produced between the copper and the tin. The melting point of the intermetallic compound produced by the copper and tin is higher than the melting point of tin. It was found that, for this reason, even when the strands are heated, the outer surfaces of the strands do not melt sufficiently, and thus the welding of the strands together is insufficient.

In view of this, an object of the present invention is to enable sufficient welding of multiple metal wires in at least a portion of a conductive member that is constituted by multiple metal wires.

Solution to Problem

In order to solve the foregoing problems, a conductive member according to a first aspect includes: a plurality of metal wires each including a metal strand and a metal covering layer formed around the metal strand; and a joined portion in which the plurality of metal wires are joined by melting of alloy portions of the metal covering layers, the alloy portions including a metal that forms the metal strands.

A second aspect is the conductive member according to the first aspect, wherein the metal strands are copper, and the metal covering layers are formed by performing tin plating around the copper.

A third aspect is the conductive member according to the first or second aspect, wherein the joined portion is formed with a terminal shape capable of being electrically and mechanically connected to a partner conductive portion.

A fourth aspect is the conductive member according to any one of the first to third aspects, wherein the plurality of metal wires are combined to form an elongated shape.

In order to solve the foregoing problems, a conductive member manufacturing method according to a fifth aspect includes: (a) a step of preparing a group of a plurality of metal wires each including a metal strand and a metal covering layer formed around the metal strand; and (b) a step of joining the plurality of metal wires to each other by performing heating at a temperature higher than a melting point of alloy portions of the metal covering layers, the alloy portions including a metal that forms the metal strands.

A sixth aspect is the conductive member manufacturing method according to the fifth aspect, wherein the metal strands are copper, the metal covering layers are formed by performing tin plating around the copper, and the heating temperature in the step (b) is a temperature higher than a melting point of a copper-tin alloy.

Advantageous Effects of Invention

According to the first aspect, the metal wires are joined by melting of the alloy portions, which include the metal that forms the metal strands, of the metal covering layers, and therefore the joined portion increases in size, and the metal wires can be sufficiently welded.

According to the second or sixth aspect, the metal covering layers include a copper-tin alloy. In view of this, the metal wires are joined to each other due to the melting of this copper-tin alloy, thus making it possible to sufficiently weld the metal wires.

According to the third aspect, the joined portion can serve as a terminal and a portion that can be electrically and mechanically connected to a partner conductive portion.

According to the fourth aspect, a portion of the conductive member other than the joined portion can serve as a portion that has a flexible elongated shape, and can have a configuration that is suited to use as wiring or the like.

According to the fifth aspect, the metal wires are joined by melting of the alloy portions, which include the metal that forms the metal strands, of the metal covering layers, and therefore the joined portion increases in size, and the metal wires can be sufficiently welded.

DESCRIPTION OF EMBODIMENTS

A conductive member and a conductive member manufacturing method according to an embodiment will be described below.

Conductive Member

Figure 1:
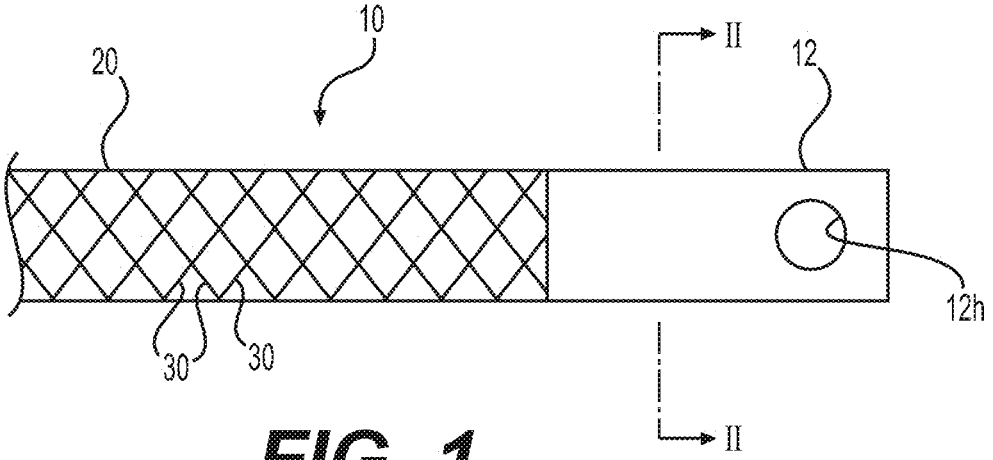
FIG. 1 is a schematic plan view of a conductive member according to an embodiment.
Figure 2:
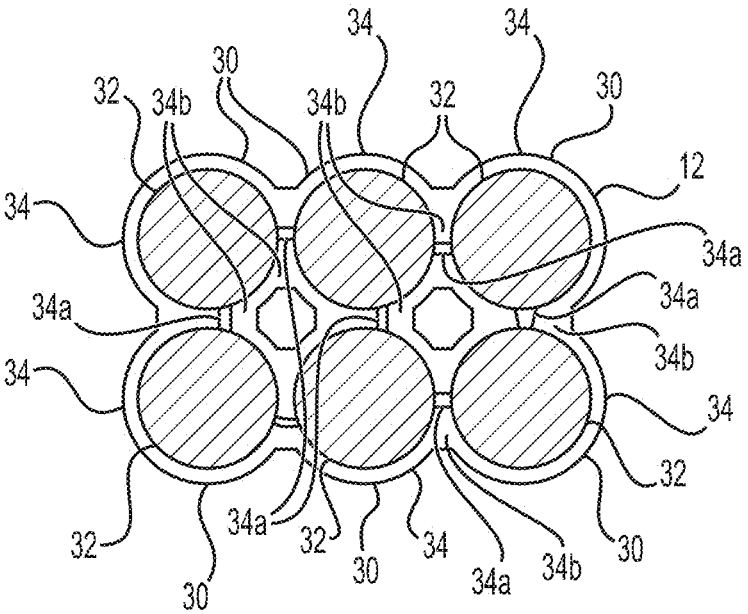
FIG. 2 is a partial cross-sectional view of a metal wire joining configuration taken along line II-II in FIG. 1.

FIG. 1 is a schematic plan view of a conductive member 10, and FIG. 2 is a partial cross-sectional view of a metal wire 30 joining configuration taken along line II-II in FIG. 1.

This conductive member 10 includes multiple metal wires 30 and a joined portion 12 constituted by the metal wires 30.

The metal wires 30 each include a metal strand 32 and a metal covering layer 34 formed around the metal strand 32.

Each metal strand 32 is formed as a single wire formed by a metal, for example. The metal covering layer 34 is formed by a metal that is different from the metal that forms the metal strand 32, and is a thin layer that covers the outer peripheral surface of the metal strand 32. The metal covering layer 34 is conceivably a metal plating layer that is formed around the metal strand 32.

Copper is envisioned as the metal that forms the metal strand 32, and tin is envisioned as the metal that forms the metal covering layer 34.

An elongated conductive member 20 is formed by combining multiple metal wires 30 so as to form an elongated shape. The elongated conductive member 20 may be a member formed by weaving the metal wires into a tube (tubular braided member, for example), may be a member formed by weaving the metal wires into a shape that is originally a belt shape (a sheet-shaped metallic cloth or net, for example), or may be a member formed by twisting the metal wires together.

In at least a portion in the extending direction of the elongated conductive member 20, the metal wires 30 are joined by being heated and pressed in a state where the metal wires 30 are grouped together, thereby forming the joined portion 12.

It is preferable that in the joined portion 12, the metal strands 32 themselves maintain their original wire shape and do not melt.

Also, the metal covering layer 34 includes portions 34*a* in which the metal forming the metal covering layer 34 remains as-is, and an alloy portion 34*b*. The alloy portion 34*b* is a portion formed by an alloy of the metal that forms the metal covering layer 34 and the metal that forms the metal strand 32. For example, when the metal covering layer 34 is formed on the metal strand 32, the alloy portion 34*b* is formed as an intermetallic compound. For example, the aforementioned portions 34*a* are portions where tin remains, and the alloy portion 34*b* is a copper-tin alloy. The copper-tin alloy includes either one of or both $Cu_3Sn$ and $Cu_6Sn_5$, for example.

In the joined portion 12, the metal wires 30 are joined by melting of the alloy portions 34*b*. The alloy portions 34*b* exist in and fill spaces that are narrower than the spaces between the metal wires 30, and join the metal wires 30 to each other. For this reason, the metal wires 30 are welded to each other with a relatively strong joining strength, and the joined portion 12 readily holds a constant shape.

Therefore, according to this conductive member 10, the metal wires 30 are joined by melting of the alloy portions 34*b*, which include the metal that forms the metal strands 32, of the metal covering layers 34, and thus the metal wires 30 can be welded with sufficient strength.

Also, here, the joined portion 12 is formed with a terminal shape capable of being electrically and mechanically joined to a partner conductive portion. Specifically, the joined portion 12 is formed with a terminal shape capable of being mechanically connected to the partner conductive portion so as make separation therefrom difficult, in a state of being electrically joined to the partner conductive portion.

Here, the joined portion 12 is formed with a plate shape having a hole 12*h* capable of being fixed by bolt-fastening to a partner member. Other shapes envisioned for the joined portion having a terminal shape are a pin or tab male terminal shape, and a tubular female terminal shape.

In this way, even if the joined portion 12 is terminal-shaped, the metal wires 30 are connected to each other by the alloy portions 34*b*, and therefore the terminal shape can be firmly maintained, thus making it possible to sufficiently function as a terminal.

Accordingly, it is possible to electrically and mechanically connect this conductive member 10 to the partner conductive portion via the terminal-shaped joined portion 12, while also reducing the number of constituent components.

Also, in the portion of the conductive member 10 other than the portion where the joined portion 12 is formed, the metal wires 30 are combined so as to form an elongated shape, and therefore this portion can bend easily. It is therefore possible to easily bend this conductive member 10 so as to be routed along a predetermined routing path or the like. In other words, the conductive member 10 can have a configuration in which one portion is hard, and another portion is suited to wire routing or the like.

Conductive Member Manufacturing Method

The following describes a method for manufacturing the conductive member 10.

Figure 3:
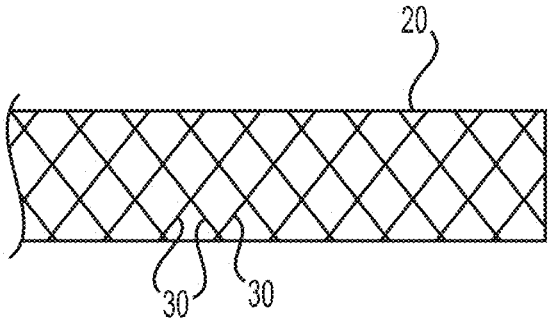
FIG. 3 is an illustrative diagram showing steps for manufacturing the conductive member.

First, as shown in FIG. 3, the elongated conductive member 20, in which the metal wires 30 are combined to form an elongated shape, is prepared (step (a)). Here, the elongated conductive member 20 has a flattened belt shape.

Figure 4:
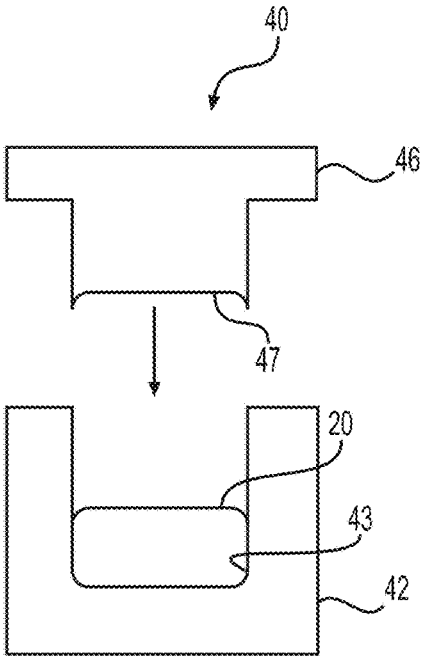
FIG. 4 is an illustrative diagram showing steps for manufacturing the conductive member.

Next, as shown in FIG. 4, the metal wires 30 are heated to a temperature higher than the melting point of the alloy portions 34*b* and joined to each other (step (b)).

Here, a portion (end portion) in the extending direction of the elongated conductive member 20 is disposed in a joining die 40, and the metal wires 30 are pressed and heated to join the metal wires 30 to each other. This joining die 40 includes a lower die 42 and an upper die 46. A recessed portion 43 having a width dimension that corresponds to the width direction of the joined portion 12 is formed in the lower die 42, and a protruding portion 47 that can be disposed inside the recessed portion 43 so as to obstruct the upper space of the recessed portion 43 is formed in the upper die 46.

A portion (end portion or the like) in the extending direction of the elongated conductive member 20 is disposed inside the recessed portion 43. In this state, the protruding portion 47 is pressed into the recessed portion 43. Accordingly, the elongated conductive member 20 is pressed downward, and in this state, the elongated conductive member 20 is partially pressed and heated via the joining die 40, which has been heated by a heater or the like. Accordingly, the metal wires 30 are joined together and enter a state of maintaining a constant shape.

Figure 5:
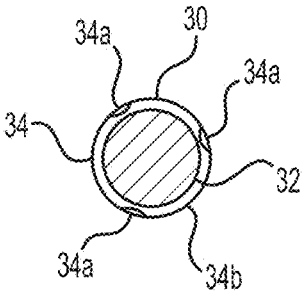
FIG. 5 is a cross-sectional view of a metal wire.

Here, FIG. 5 shows the configuration when observing a cross-section of the metal wires 30. Specifically, the metal covering layers 34 are formed on the outer peripheral surfaces of the metal strands 32. Normally, when the metal strands 32 are plated, an intermetallic compound is produced as an alloy of the metal that constitutes the metal strands 32 and the plating metal. For this reason, the metal covering layer 34 includes the portions 34*a* in which the original metal remains as-is and the alloy portion 34*b*, and in most cases, the alloy portion 34*b* occupies a majority portion, and the portions 34*a* remain in a slight amount.

Also, the portions 34*a* are tin portions, and the alloy portion 34*b* is a copper-tin alloy portion, or more specifically a portion that includes one of or both $Cu_3Sn$ and $Cu_6Sn_5$, for example. The melting point of tin is 231.9 degrees. The melting point of the copper-tin alloy is approximately 400 to 700 degrees (e.g., the melting point of $Cu_3Sn$ is approximately 415 degrees, and the melting point of $Cu_6Sn_5$ is approximately 676 degrees).

Figure 6:
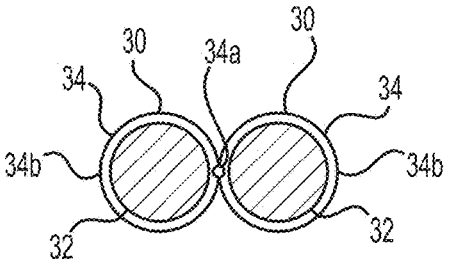
FIG. 6 is an illustrative diagram showing a metal wire joining configuration according to a comparative example.

For this reason, when the metal wires 30 are heated, if heating is performed at a temperature that is greater than or equal to the melting point of tin and furthermore is less than or equal to the melting point of the copper-tin alloy (e.g., if heating is performed at 300 degrees), only the tin portions 34*a* melt. For this reason, as shown in FIG. 6, the metal wires 30 are joined by only the slight number of portions 34*a* that exist at points. Accordingly, in this case, the joining strength of the metal wires 30 is weak, and the ability to maintain shape is low. Note that the heating temperature mentioned here is the temperature at which the elongated conductive member 20 is heated by the joining die 40, and is the surface temperature of the recessed portion 43 and the protruding portion 47, for example.

When the metal wires 30 are heated, if heating is performed at a temperature that is greater than or equal to the melting point of the copper-tin alloy and furthermore is less than or equal to the melting point of copper (melting point of copper is 1085 degrees) that forms the metal wires 30 (e.g., if heating is performed at 500 degrees), the tin portions 34*a* and the copper-tin alloy portions 34*b* melt. The melted tin and tin alloy moves so as to fill small gap portions between the metal strands 32 due to surface tension. In other words, the melted tin and copper-tin alloy move to portions in the vicinity of locations of contact between the metal strands 32 due to surface tension. If the melted tin and copper-tin alloy cool and harden in this state, the metal wires 30 are joined to each other by thicker tin and tin alloy portions. For this reason, the metal wires 30 more firmly maintain a constant shape.

Note that in the case where the metal covering layer 34 includes multiple types of alloys, the temperature greater than or equal to the melting point of the copper-tin alloy is a temperature that is greater than or equal to the lowest melting point among the melting points of the various alloys. This is because it is thus possible to cause at least a portion of the copper-tin alloy to melt so as to more firmly join the metal wires 30 to each other. Of course, in the case where the metal covering layer 34 includes multiple types of alloys, if heating is performed at a temperature that is greater than or equal to the highest melting point among the melting points of the various alloys, the metal wires 30 can be joined to each other more firmly.

Figure 7:
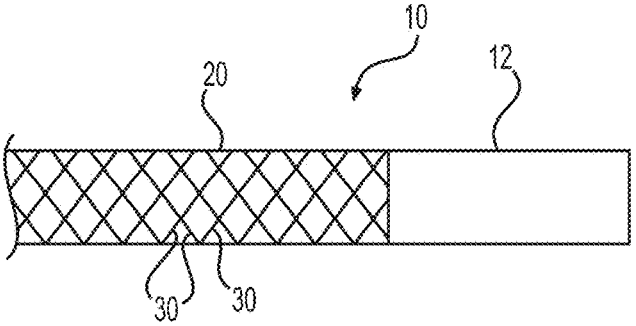
FIG. 7 is an illustrative diagram showing steps for manufacturing the conductive member.

As described above, the joined portion 12, in which the metal wires 30 are joined to each other, is formed with a flattened rectangular plate shape as shown in FIG. 7. Thereafter, when a hole 12*h* or the like is formed in the joined portion 12, the joined portion 12 is given a terminal shape.

Accordingly, it is possible to more reliably melt the alloy portions 34*b*, which include the metal that forms the metal strands 32, of the metal covering layers 34, and to sufficiently weld the metal wires 30 to each other by the large joined portion.

Variations

Note that the description of the above embodiment mainly presumes that the metal forming the metal strands 32 is copper, and that the metal forming the metal covering layers 34 is tin, but these metals are not essential. If the melting point of the alloy of the metal forming the metal strands and the metal forming the metal covering layers is higher than the melting point of the original metal forming the metal covering layers 34, it is possible to similarly achieve a configuration in which the metal wires are joined via the alloy when heated at a temperature higher than the melting point of the alloy.

Also, although the example of forming the joined portion 12 with a terminal shape is described in the above embodiment, this is not necessarily required. The configuration described in this embodiment can be applied when there is a desire to partially harden a portion of a conductive member that is constituted by multiple metal wires.

Figure 8:
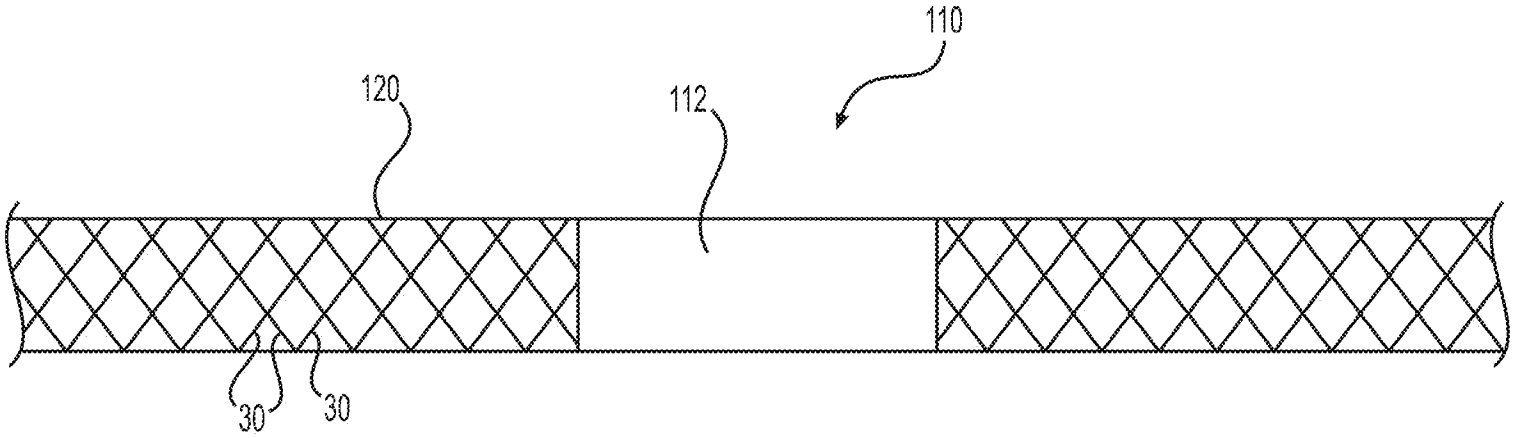
FIG. 8 is a schematic plan view of a conductive member according to a variation.

For example, a configuration is possible in which, as shown in FIG. 8, an intermediate portion in the extending direction of an elongated conductive member 120 constituted by multiple metal wires 30 is pressed and heated to join the metal wires 30 to each other and form a joined portion 112, similarly to the joined portion 12. In this case, a portion of the intermediate portion in the extending direction of a conductive member 110 can be partially hardened for route restriction, for example, and the other portions can remain flexible, thus making it possible to form the conductive member 110 that includes both flexible portions and a hard portion that enables route restriction.

The configurations described in the above embodiment and variations can be appropriately combined as long as no contradiction arises.

Although this invention has been described in detail above, the above description is illustrative in all respects, and this invention is not limited to the above description. It will be understood that numerous variations not illustrated here can be envisioned without departing from the range of this invention.

LIST OF REFERENCE NUMERALS

10, 110 Conductive member
12, 112 Joined portion
12*h* Hole
20, 120 Elongated conductive member
30 Metal wire
32 Metal strand
34 Metal covering layer
34*b* Alloy portion

The invention claimed is:

1. A conductive member comprising:

a plurality of metal wires each including a metal strand and a metal covering layer formed of a metal that is different from the metal of the metal strand and formed around the metal strand; and a joined portion in which the plurality of metal wires are joined by melting of alloy portions of the metal covering layers and portions of the metal strands, the alloy portions including a metal that forms the metal strands.

2. The conductive member according to claim 1, wherein the metal strands are copper, and the metal covering layers are formed by performing tin plating around the copper.

3. The conductive member according to claim 1, wherein the joined portion is formed with a terminal shape configured to be electrically and mechanically connected to a partner conductive portion.

4. The conductive member according to claim 1, wherein the plurality of metal wires are combined to form an elongated shape.

5. A conductive member manufacturing method comprising:

(a) preparing a group of a plurality of metal wires each including a metal strand and a metal covering layer formed of a metal that is different from the metal of the metal strand and formed around the metal strand; and (b) joining the plurality of metal wires to each other by performing heating at a temperature higher than a melting point of alloy portions of the metal covering layers and portions of the metal strands, the alloy portions including a metal that forms the metal strands.

6. The conductive member manufacturing method according to claim 5, wherein the metal strands are copper, the metal covering layers are formed by performing tin plating around the copper, and the heating temperature is a temperature higher than a melting point of a copper-tin alloy.

* * * * *